US007954520B2

(12) United States Patent
England

(10) Patent No.: US 7,954,520 B2
(45) Date of Patent: Jun. 7, 2011

(54) PORTABLE SAND BAG HOPPER

(76) Inventor: James Michael England, Carlinville, IL (US)

( * ) Notice: Subject to any disclaimer, the term of this patent is extended or adjusted under 35 U.S.C. 154(b) by 351 days.

(21) Appl. No.: 12/233,716

(22) Filed: Sep. 19, 2008

(65) Prior Publication Data

US 2010/0071806 A1 Mar. 25, 2010

(51) Int. Cl.
*B65B 3/16* (2006.01)

(52) U.S. Cl. ..... 141/114; 141/10; 141/301; 141/314; 141/391; 248/99

(58) Field of Classification Search ..... 141/10, 141/114, 301, 314–316, 391; 248/99–101
See application file for complete search history.

(56) References Cited

U.S. PATENT DOCUMENTS 904,695 A * 11/1908 Herrick ..... 248/97
1,253,948 A * 1/1918 Dugas ..... 248/101
1,254,371 A * 1/1918 Smith ..... 248/101
1,732,271 A * 10/1929 Theodore ..... 222/179
1,823,283 A * 9/1931 Neuman ..... 53/52
2,098,324 A * 11/1937 Ward et al. ..... 177/76
2,304,744 A * 12/1942 Snyder ..... 134/133
2,663,466 A * 12/1953 Heltzel ..... 222/505
3,552,346 A * 1/1971 Garden ..... 141/72
5,417,261 A * 5/1995 Kanzler et al. ..... 141/313
5,873,396 A * 2/1999 Biebrach et al. ..... 141/231
6,047,863 A * 4/2000 Kanzler et al. ..... 222/238
6,119,740 A * 9/2000 Wilham et al. ..... 141/391
6,216,753 B1 * 4/2001 Kanzler et al. ..... 141/313
7,472,727 B1 * 1/2009 Sherrard ..... 141/316

* cited by examiner

*Primary Examiner* — Timothy L Maust
(74) *Attorney, Agent, or Firm* — Don W. Weber

(57) ABSTRACT

A highly portable sand bag hopper has the shape of a cabinet with the front open. The flat, solid top of the cabinet has a loading opening for loading sand into a lower cone. A horizontal sliding door located near the lower, smaller tapered end of the cone opens and closes the lower discharge opening by pulling a spring-loaded lever arm. The upper part of the cone is loaded with sand at a predetermined level to discharge discreet amounts of sand. A seal may be located around the lower opening to sweep sand or debris from the top of the discharge door.

4 Claims, 5 Drawing Sheets

PORTABLE SAND BAG HOPPER

BACKGROUND OF THE INVENTION

This invention relates to the general field of emergency services. More particularly, a portable sand bag hopper is presented that may be used in remote locations.

In the field of emergency services it is often necessary to fill sand bags, particularly in flooding conditions. Hundreds of thousands of sand bags are often required for dykes or temporary dams. The need for a large number of sand bags under emergency conditions is often required at remote locations without power or other sources of energy. While sand bags are very useful to control rising water, filling the sand bags at remote locations can be cumbersome and time consuming, relying particularly on manual labor.

A number of prior patents have approached the problem of rapid and efficient sand bag filling. One such device, described in the 2000 US patent issued to Wilham (U.S. Pat. No. 6,119,740) is for a sand bag filler having a hopper 3 and a lower discharge door 6. This Wilham device is made to be attached to a larger discharge hopper or bin which fills the lower hopper as desired. The door of Wilham is attached to the lower outside part of the bin and pivots vertically to discharge sand into sand bags. While Wilham is useful in places where access to a larger bin or hopper is available, it could not be used in remote locations and is not designed to be used independently of a larger sand hopper. It is an object of this invention to provide a highly portable device for filling sand bags at remote emergency locations. It is another object of this device to provide an independently operated sand bag hopper where sand is deposited in an upper cone and discharged into a sand bag by pulling a lever.

Several portable devices for filling sand bags have been introduced into this field previously. Both of the sand bag fillers described by Henderson (1999 U.S. Pat. No. 5,927,356) and by Payne (2002 U.S. Pat. No. 6,374,874) are portable. Henderson's device for dispensing fluent materials has a discharge chute 6 but no lower door. The Henderson device, although portable, does not allow for the dispensing of a discrete, pre-determined amount of sand into an empty sand bag. Payne disclosed a circular log-type sand bag filler that rotates from the horizontal to the vertical to discharge sand into the lower sand bag. While useful, the Payne device, when filled with heavy sand, must be rotated upwardly to fill the sand bag. Payne also does not allow for the discharge of a discrete amount of sand into a sand bag. It is a further object of this invention to provide a highly portable sand bag filler that allows a workman to fill a discrete amount of sand into a sand bag at a remote location. Another object of this invention is to provide a sand bag filler requiring no electricity or outside power that requires that the sand be lifted only once prior to discharge into the sand bag, by filling the lower cone to a discrete and predetermined level.

The instant sand bag hopper is lightweight, safe and highly portable. Requiring no outside power source, it may be used for filling sand bags at any location that a workman can reach on foot. Due to its design, sand need only be lifted once as it is loaded into the cone. Since the lower cone door is biased closed, sand bags may be rapidly prepared with a precise amount of predetermined sand with much less manpower required for other devices. It is a still further object of this invention to provide a safe, efficient, labor-saving, highly portable sand bag hopper for filling sand bags at a remote location.

Other and further objects of this invention will become obvious upon reading the below description of the device.

BRIEF DESCRIPTION OF THE INVENTION

A portable sand bag hopper has the size and general shape of a small cabinet. The hopper has a horizontal top with an opening for depositing sand in the lower cone, and three vertical rectangular sides. One vertical side of the hopper is open. A lower horizontal shelf near the bottom of the hopper supports the sand bag when loading. Directly below the top opening is a cone with its upper larger end attached to the hopper top. A sliding horizontal discharge door is attached to the cone at its lower smaller end. A discharge lever is attached to the sliding door and is biased in the closed position. To fill sand bags, a worker places an empty sand bag underneath the lower smaller part of the cone. The cone is then filled with sand to a certain predetermined level. The worker then pulls the discharge lever, opening the sliding door and discharging the predetermined amount of sand into the sand bag. The lever is then released, closing the door and the process may be repeated as often as necessary to fill sand bags.

DESCRIPTION OF THE DRAWING FIGURES

DETAILED DESCRIPTION OF THE PREFERRED EMBODIMENT

Figure 1:
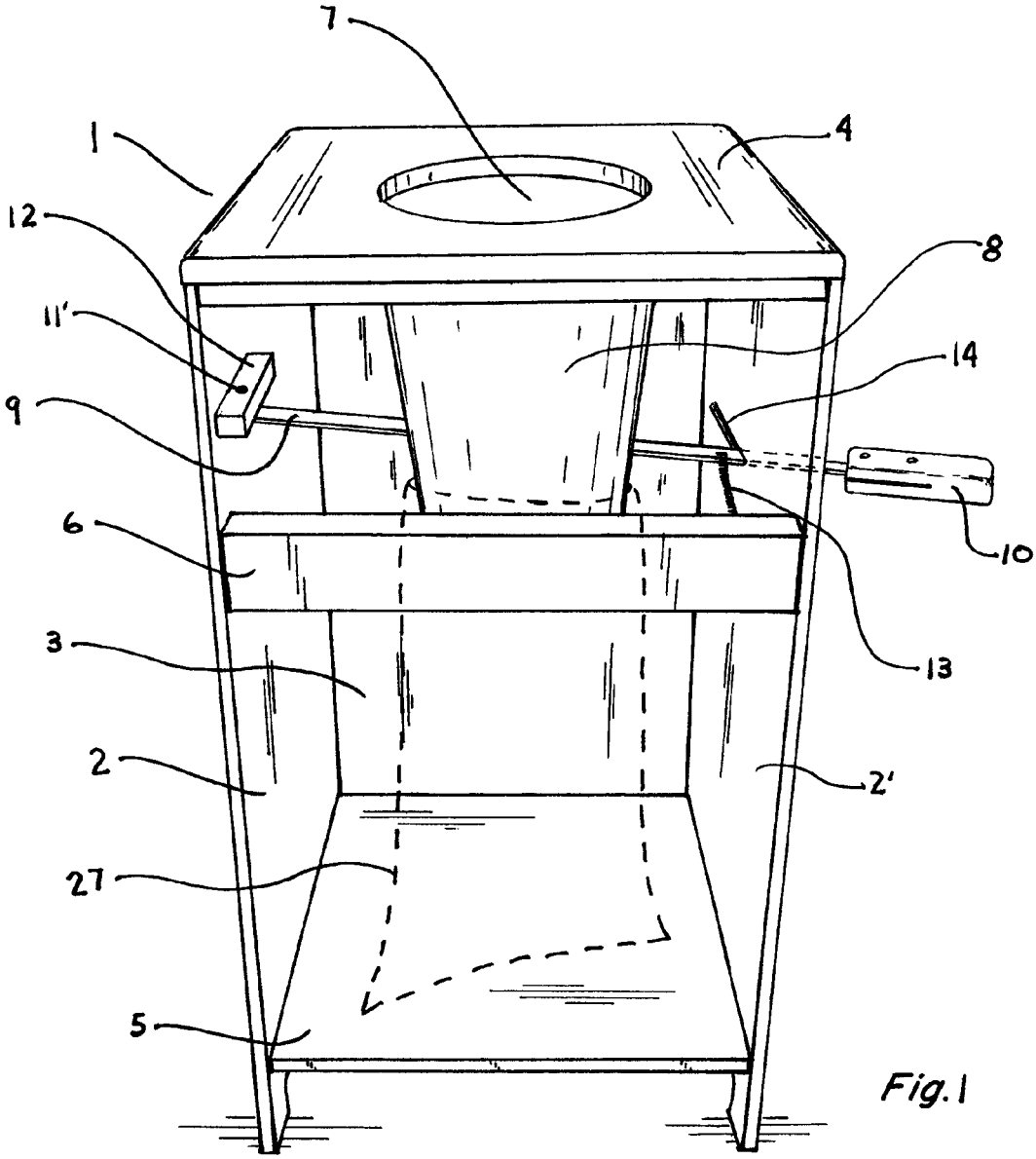
FIG. 1 is a perspective view of the sand bag hopper as seen from the front of the device.

This new invention discloses a portable sand bag hopper used to fill sand bags at remote locations. The portable hopper cabinet 1 has the shape of a cabinet with an essentially square horizontal cross-section and a rectangular vertical cross-section. The hopper cabinet 1 has left 2 and right 2' essentially vertical sides connected to an essentially vertical back 3, as best shown on FIG. 1. The left and right sides and back are connected to each other and to an essentially horizontal top 4. An essentially horizontal bottom shelf 5 is attached to the sides and back near the lower part of the cabinet 1. A side brace 6 is connected between the two sides 2 and 2' to ensure greater stability. It is to be understood that the essentially square/rectangular shape of the preferred embodiment cabinet shown and described is meant as an illustration only and not as a limitation. The cabinet could be of any shape, such as cylindrical and still be within the spirit and disclosure herein.

The top 4 of the cabinet 1 has a circular hole or opening 7 therein. This circular opening is adapted to receive the upper, larger part of the loading cone 30. To use the device, sand is loaded into the lower sand bag 27, shown in phantom lines in FIG. 1, through the top opening 7. A circular top opening is preferred but not required.

A discharge lever 9 is located near the upper part of the cabinet 1. This discharge lever has an outer handle end 10 and an inner pivot end 11. The outer handle 10 extends outside the right side 2' of the cabinet 1 through the side lever slot 14. A discharge lever brace 12 is attached to the left side 2 of the cabinet as shown. A discharge lever spring 13 is attached between the discharge lever 9 and the side brace 6 as shown.

The spring biases the lever 9 in the closed position as shown in FIG. 1, towards the brace 6 and the front of the cabinet 1. The discharge lever 9 pivots about pivot point 11' to discharge the sand from hopper 8 as will be explained later in this description.

Figure 2:
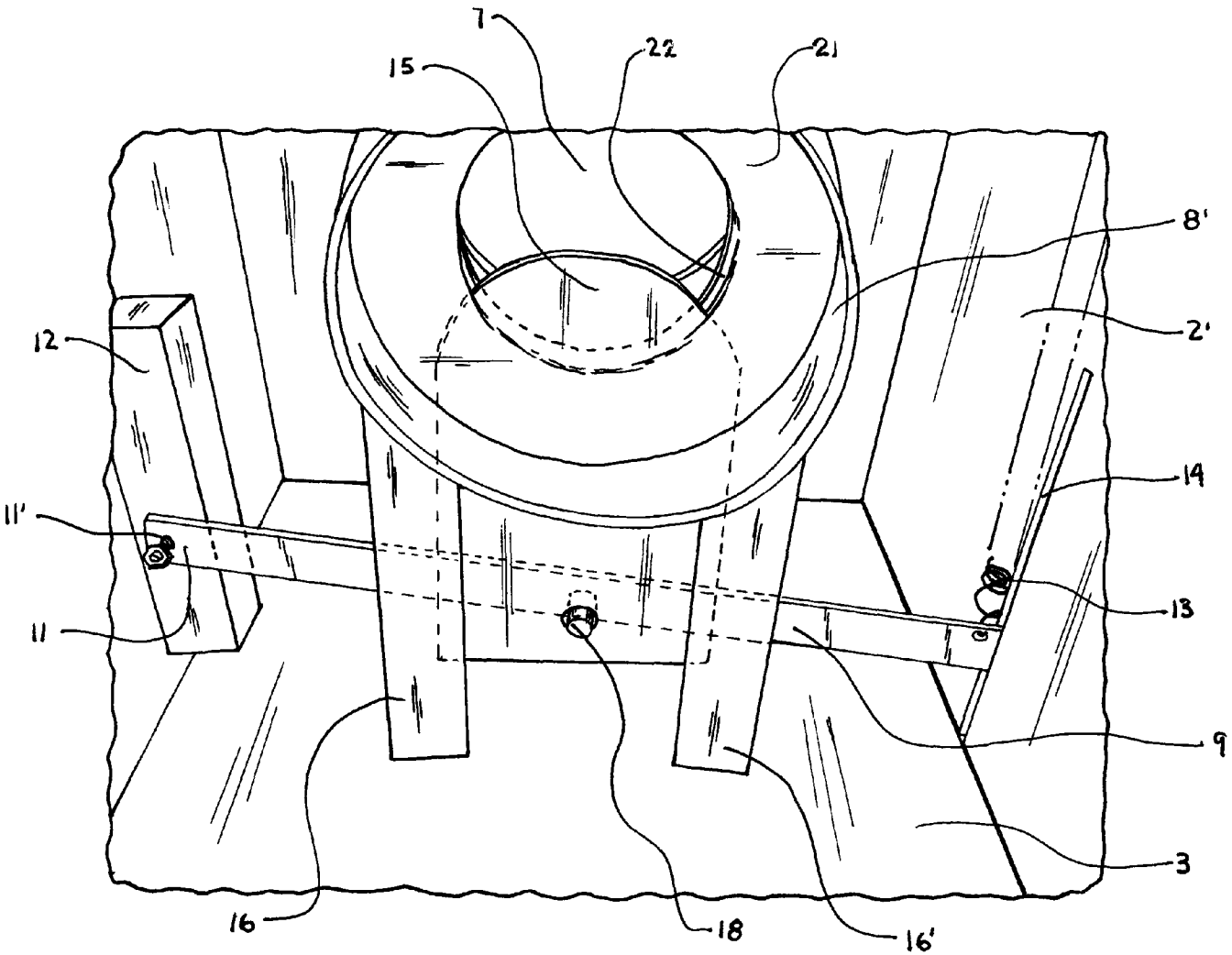
FIG. 2 is a partial perspective view of the discharge section of the sand bag hopper.
Figure 3:
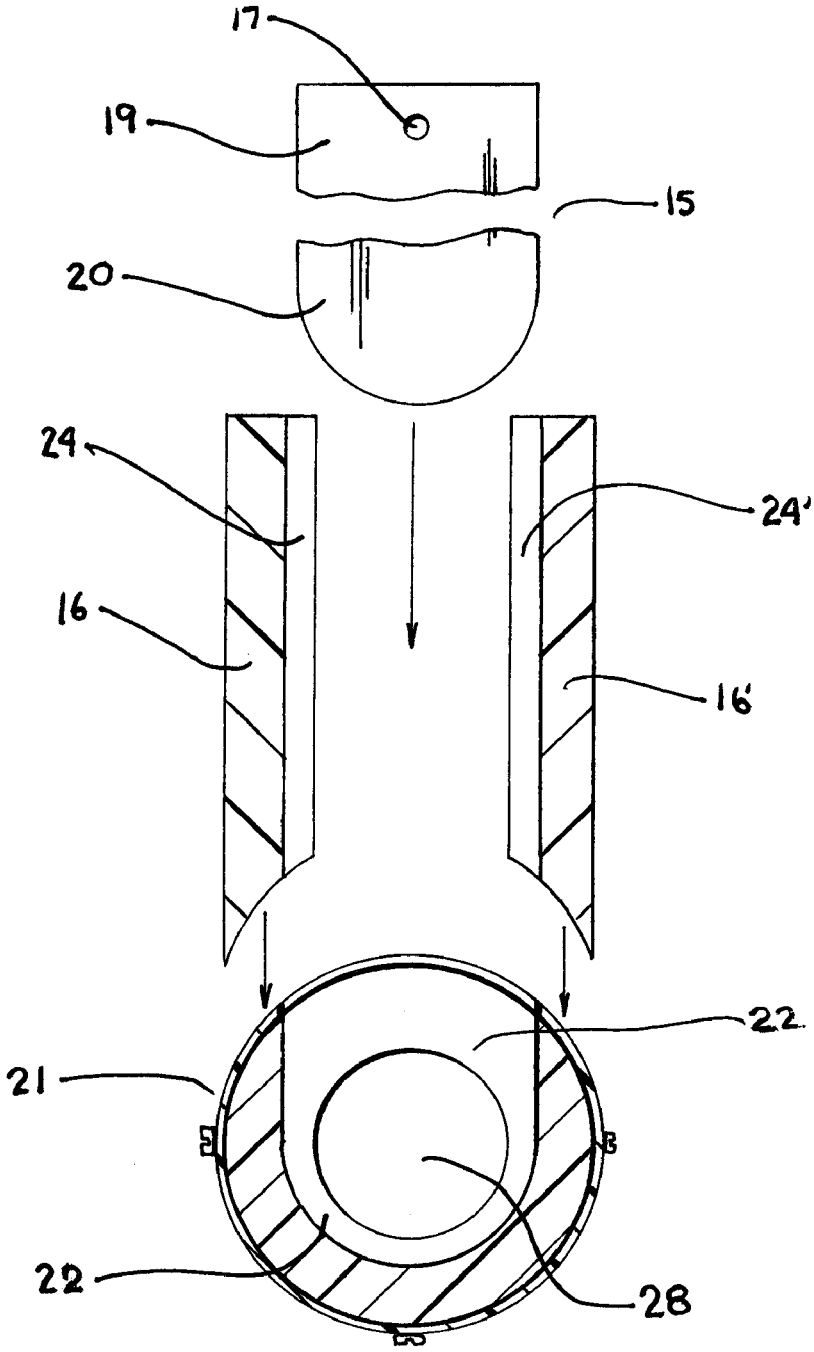
FIG. 3 is a partial plan view of the lower discharge door, track and conical discharge piece.
Figure 4:
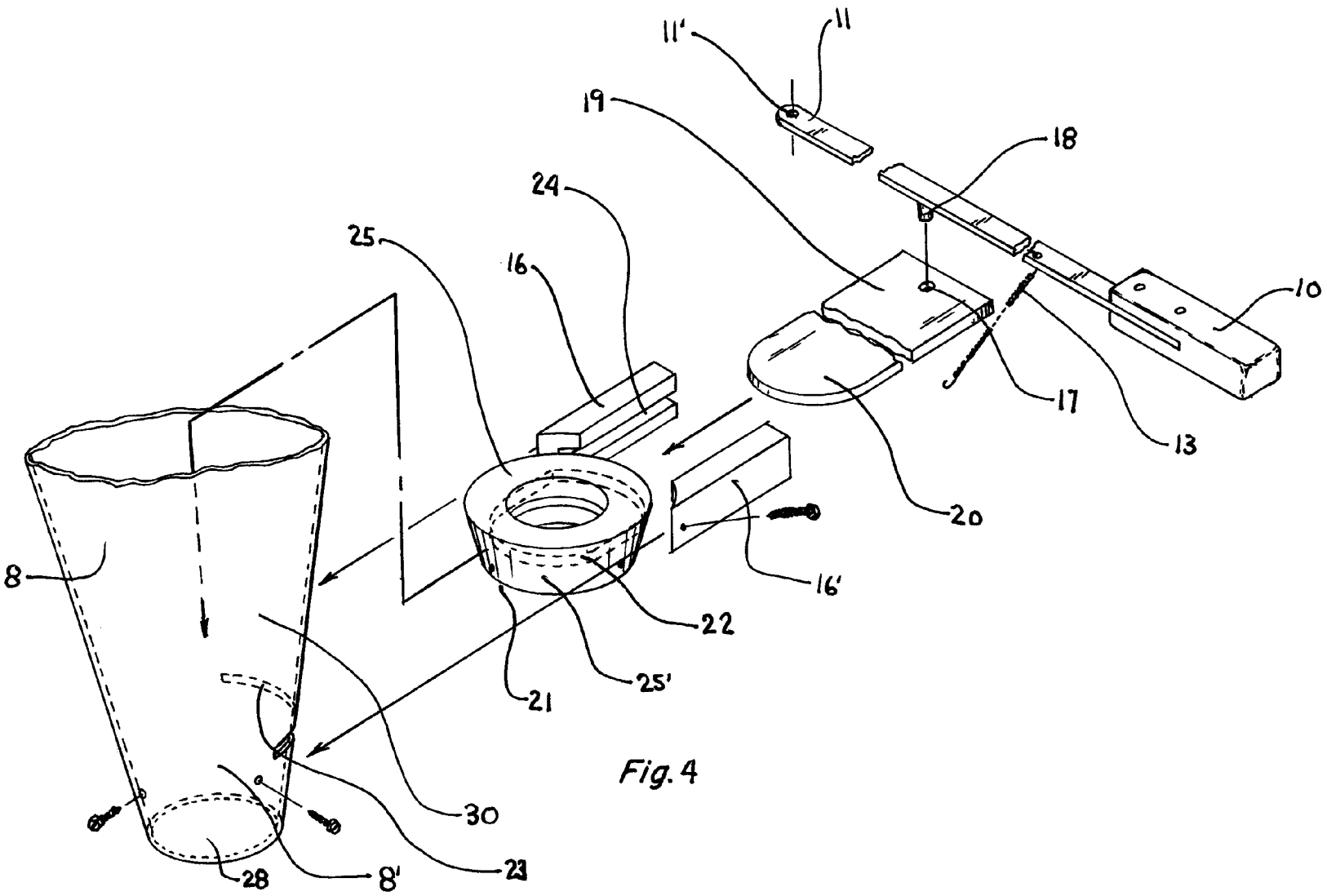
FIG. 4 is a perspective exploded perspective view of the cone, lower discharge piece, door and lever.

Turning now to FIGS. 2, 3 and 4, the discharge door and mechanism is shown. A flat, lower discharge door 15 has an irregular shape with a rectangular end 19 and a semi-circular end 20. The discharge door 15 slides along the left 16 and right 16' door tracks and into a lower frustro-conical discharge piece 21. The discharge door 15 has a door pivot hole 17 cut out from the rectangular end 19 of door 15. The discharge lever 9 has a corresponding pin 18. Door hole 17 is adapted to rotatably receive lever pin 18 to slide the door 15 open and closed.

A lower frustro-conical discharge piece 21 is attached near the lower smaller end of the cone and is adapted to receive the semi-circular end 20 of discharge door 15 when the door is in the closed position. The frustro-conical piece 21 is attached inside the cone near the lower tapered section of the cone. Upper larger section 8 of the cone and lower, smaller tapered section 8' of the cone are divided by the frustro-conical discharge piece 21 and the sliding door 15.

The frustro-conical piece 21 has a door slot 22 cut therefrom. This door slot 22 is adapted to receive the semi-circular end of door 15 when the door is closed. The cone also has a slot 23 cut therefrom to allow the door 15 to slide into and out of the frustro-conical discharge piece 21. The cone slot 23 is located between the upper 8 and lower tapered 8' sections of the cone. The frustro-conical discharge piece 21 may be constructed from an upper section 25 and a lower section 25'. Alternatively, the piece 21 may be a one-piece solid construction with slot 22 cut therefrom.

Discharge door tracks 16 (left) and 16' (right) have door slots 24 (left) and 24' (right). Discharge door 15 slides in and out of frustro-conical discharge piece 21 through frustro-conical piece slot 22 and along door tracks 16 and 16'. When discharge lever 9 is pulled towards the back 3 of cabinet 1, discharge door 15 moves from left to right in FIG. 4, opening the lower tapered part 8' of the hopper cone and discharging the sand into the lower sand bag.

Figure 5:
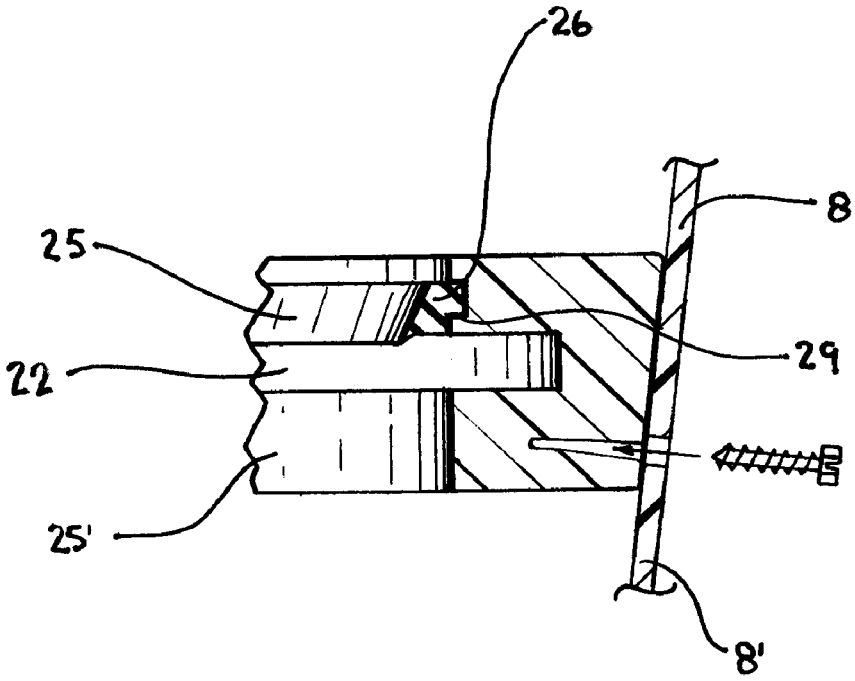
FIG. 5 is a partial side cutaway view of the frustro-conical discharge piece, door slot and seal.
Figure 6:
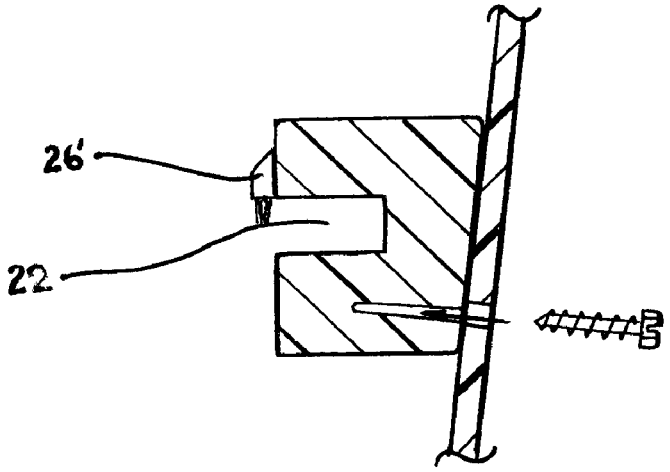
FIG. 6 is similar to FIG. 5 showing an alternate seal mechanism.

As shown on FIGS. 5 and 6 a circular seal 26 may be placed on the inner circumference of lower discharge hole 28 next to the upper surface of discharge door 15. This circular seal 26 is used to sweep sand or other debris from the top surface of discharge door 15 when it is withdrawn from frustro-conical piece 21 during discharge of sand from the upper part 8 of the cone. This seal 26 may be made of rubber, silicone or any other suitable material. In one embodiment it is secured to the upper part of piece 21 in a seal groove 29 and protrudes into the frustro-conical piece slot 23 as shown. Alternatively, a simple brush-type seal 26' may be attached around the inner circumference of the frustro-conical piece 21.

Sand bag ears (not shown) may also be added to the lower part of the cone beneath the discharge door to support the sand bag during one-man operation.

The operation of the device is simple yet effective. The discharge door 15 is in the normally closed position due to lever spring 13. In this position the semi-circular part 20 of door 15 is located in frustro-conical discharge piece slot 23. Sand is loaded into the upper larger part of the cone to a predetermined, measured set level. This level may be marked on the inside of the upper part 8 of the cone and determines a measured pre-set and discrete amount of sand. A sandbag 27 is attached to lower ears or held in place under the cone opening or discharge hole 28 located underneath the lower, smaller tapered portion 8' of the inner cone. When discharge lever 9 is pulled towards the back 3 of the cabinet, discharge door 15 slides towards the back of the cabinet and the semi-circular part 20 of door 15 is withdrawn from the lower opening 28. This pivoting lever movement of the door allows the pre-measured sand to discharge into the sand bag. The seal 26 sweeps the sand from the top of the sliding door.

The inner tapered cone of this device may be made from the commercial traffic cones in common use by removing the rectangular base of the traffic cone and cutting the top and bottom of the cone to the desired size. Alternatively, the cone may be manufactured specially for this device. The cabinet is safe, lightweight and highly portable. Due to the unique mechanical construction of the cabinet hopper, it requires no electricity or other power source. The cabinet hopper allows one or two workers to quickly, efficiently and safely fill sand bags with a discrete amount of sand. The device may be adapted to fill many different type and sizes of sandbags in remote emergency or other extreme conditions.

The invention claimed is:

1. A portable sandbag hopper for filling sand bags at a remote location, comprising:

(a) An essentially rectangular cabinet having an open front and essentially vertical sides and back connected to a solid essentially horizontal top, said top having an essentially circular opening adapted to receive the upper, larger part of a loading cone;

(b) A loading cone inside of said cabinet wherein the upper, larger part of said cone is attached to said upper top opening, the lower, smaller tapered part of said cone having a discharge hole wherein said lower part of said cone further comprises a frustro-conical discharge piece with a central hole therein having a door slot cut therefrom adapted to receive the semi-circular end of a discharge door;

(c) A horizontal, slidable flat discharge door having a rectangular end and a semi-circular end located in the lower part of said cone, wherein said semi-circular end of said door is adapted to slide into said door slot and wherein said door is adapted to slide to open or close the lower discharge hole;

(d) A hand-operated discharge lever pivotably connected to one side of said cabinet, connected to said discharge door and biased towards the closed position by a spring;

(e) A circular seal next to the upper surface of said discharge door to sweep sand or other debris from the upper surface of said discharge door;

wherein when a workman manually pulls said discharge lever towards the back of said cabinet said lever opens said discharge door and allows sand to be discharged from said loading cone;

wherein said portable hopper may be manually operated by hand at remote emergency locations.

2. A portable sand bag hopper as in claim 1, wherein said seal on top of said slidable door comprises a brush-type seal attached around the inner circumference of said frustro-conical discharge piece.

3. A portable sandbag hopper as in claim 1, further comprises left and right discharge door tracks attached between one side of said cabinet and the lower part of said loading cone, each track having a track slot, adapted to receive said discharge door.

4. A portable sandbag hopper as in claim 1, further comprising a level marking located on the inside of said loading cone whereby a measured, pre-set and discrete amount of sand may be discharged into a sandbag.

* * * * *